United States Patent [19]

Shiokawa

[11] 4,195,564

[45] Apr. 1, 1980

[54] MACHINE PRESS

[76] Inventor: Hiroyasu Shiokawa, 9-3 Sone-Nishimachi 4-Chome, Toyonaka City, Prefecture of Osaka, Japan

[21] Appl. No.: 959,780

[22] Filed: Nov. 13, 1978

[30] Foreign Application Priority Data

Dec. 10, 1977 [JP] Japan ..... 52/148559

[51] Int. Cl.[2] ..... B30B 1/06

[52] U.S. Cl. ..... 100/231; 83/628; 100/283

[58] Field of Search ..... 100/231, 280, 282, 283, 100/284, 285, 293, 295; 83/628; 403/137

[56] References Cited

U.S. PATENT DOCUMENTS

| | | | |
|---|---|---|---|
| 2,187,915 | 1/1940 | Ruffo | 403/137 |
| 2,600,242 | 6/1952 | May | 100/283 X |
| 3,302,505 | 2/1967 | Shiokawa | 100/231 X |

FOREIGN PATENT DOCUMENTS

| | | | |
|---|---|---|---|
| 836888 | 4/1952 | Fed. Rep. of Germany | 100/282 |
| 913851 | 6/1954 | Fed. Rep. of Germany | 100/283 |
| 1253828 | 1/1961 | France | 100/283 |
| 42-837695 | 11/1967 | Japan | 100/231 |

*Primary Examiner*—Billy J. Wilhite

*Attorney, Agent, or Firm*—Wenderoth, Lind & Ponack

[57] ABSTRACT

A machine press includes a frame having an upper ram-supporting portion and a lower workpiece-supporting portion. A ram is mounted within the ram-supporting portion of the frame for upward and downward movement therein away from and toward the workpiece-supporting portion of the frame. The ram has therein a recess. The ram also has upper and lower support members extending into the recess. A lever is pivotally mounted to the frame, and the lever includes an upper arm having at a free end thereof a head which extends into the recess. The head is positioned between the upper and lower support members, such that reciprocal pivoting movement of the lever results in the head reciprocably moving the ram up and down within the ram-supporting portion of the frame.

3 Claims, 4 Drawing Figures

MACHINE PRESS

BACKGROUND AND SUMMARY OF THE INVENTION

The present invention is directed to an improved machine press which is small in size while producing a high pressure and which is simple in construction but assures a long service life. It is a primary object of the present invention to provide a machine press which can produce a large degree of pressing power while being of a relatively small sized construction.

This and other objects are achieved in accordance with the present invention by the provision of a machine press including a frame having an upper ram-supporting portion and a lower workpiece-supporting portion. A ram is slidably mounted within the ram-supporting portion of the frame for upward and downward movement therein away from and toward the workpiece-supporting portion of the frame. The ram has therein a recess and upper and lower support members extending into the recess. A lever is pivotally mounted to the frame, and the lever includes an upper arm having at a free end thereof a head which extends into the recess. The head is positioned between the upper and lower support members of the ram so that reciprocal pivoting movement of the lever results in the head reciprocably moving the ram up and down within the ram-supporting portion of the frame.

Preferably, the head has upper and lower surfaces which respectively contact downwardly facing and upwardly facing surfaces of the upper and lower support members. Further preferably, the upper and lower surfaces of the head are convex cylindrical surfaces, and the downwardly facing and upwardly facing surfaces of the upper and lower support members are concave cylindrical surfaces which are complementary to the respective convex surfaces.

In accordance with a further feature of the present invention, the relative spacing between the upper and lower support members, and thereby the degree of pressure exerted by the surfaces of the support members on the surfaces of the head, is adjustable. This adjustment is preferably carried out by providing at least one screw which threadably engages and extends through the ram and which has an inner end carrying one of the support members, preferably the upper support member.

In accordance with a further feature of the present invention, the lever includes a lower arm and an arrangement for reciprocally pivoting the lever about a horizontal axis. Such arrangement includes a wheel which is rotatably mounted on the frame, a shaft eccentrically mounted on the wheel, a slot formed in the lower arm of the lever, a slidable member such as a block slidably positioned in the slot, with the shaft which is eccentrically mounted on the wheel extending into and carrying the slidable member, and means for rotating the wheel. Accordingly, rotation of the wheel will cause eccentric rotation of the shaft about the axis of the wheel, and this will cause the slidable member to move within the slot in the lever, thereby allowing the lever to reciprocally pivot about the horizontal axis. The wheel may include a gear wheel, and the arrangement for rotating the gear wheel may include a rotating flywheel and a gear train transmitting rotation of the flywheel to the gear wheel.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

With reference now to the drawings, a preferred embodiment of the machine press of the present invention will now be described.

A machine frame 1 includes an upper and forward ram-supporting portion and a lower workpiece-supporting portion positioned beneath the ram-supporting portion. The ram-supporting portion of the frame has a vertically extending opening therethrough of a configuration to slidably receive therein a vertically movable ram 2. In the illustrated embodiment, the opening and the complementarily shaped ram 2 are rectangularly shaped. However, it is to be understood that other configurations are within the scope of the invention, as will be apparent to those skilled in the art.

Figure 3:
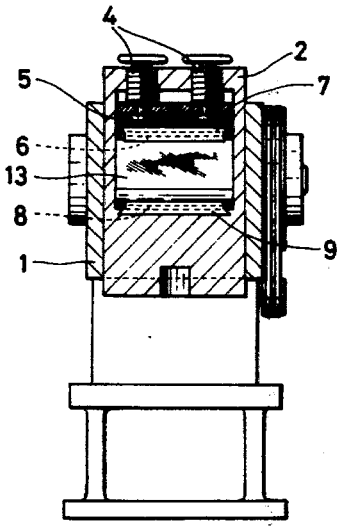
FIG. 3 is a transverse cross-sectional view of the machine press of FIG. 1.
Figure 1:
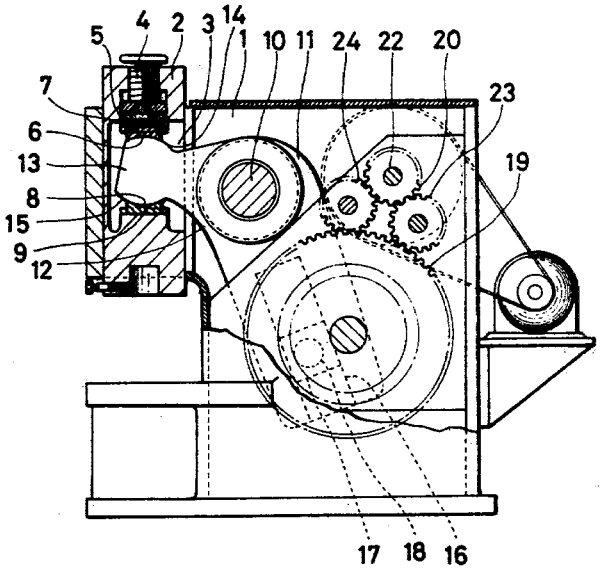
FIG. 1 is a elevation view, partially in cross-section, of the machine press of the present invention, with the ram thereof shown in the elevated position.
Figure 2:
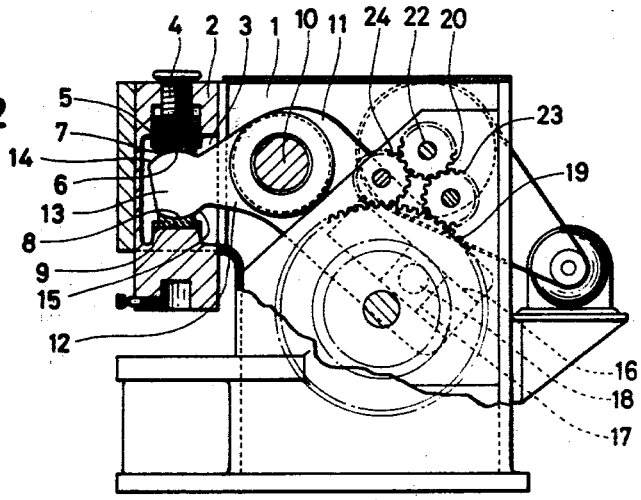
FIG. 2 is a view similar to FIG. 1, but showing the ram in the lowered position.
Figure 4:
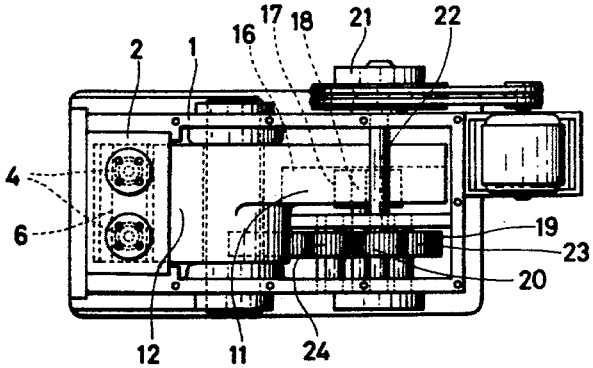
FIG. 4 is a plan view of the machine press of FIG. 1.

The ram 2 has therein a recess 3 which opens to the exterior of the ram on the rearward or right side, as viewed in FIGS. 1 and 2 of the drawings. A pair of threaded adjusting shafts 4 threadably extend through the upper part of ram 2 into the interior of recess 3. The free ends of shafts 4 support a plate 5 which in turn supports an upper support member 7 having a downwardly facing cylindrically concave surface 6. From the bottom of recess 3 of ram 2 extends a bottom support member 9 having an upwardly facing cylindrical concave surface 8.

A lever 11 is supported on frame 1 for pivoting movement about a horizontal shaft 10. Lever 11 has an upper arm 12 having at a free end thereof a head 13 having upper and lower convex surfaces 14 and 15, respectively. Surfaces 14 and 15 are complementary to surfaces 6 and 8, and head 13 is grasped between support members 7 and 9 with surfaces 6 and 8 in sliding contact with surfaces 14 and 15, respectively.

The lower arm of lever 11 has therein an elongated slot 16 which slidably receives therein a slidable member such as a block 17. A wheel, such as gear wheel 19 is rotatably mounted to frame 1 about a central axis or shaft. Wheel 19 has extending therefrom, at a position eccentric to the central shaft thereof a rod or shaft 18 which rotatably extends into block 17. A flywheel 21 is mounted on a shaft 22 and is adapted to be driven in a conventional manner, for example by the illustrated motor and belt drive system, whereby shaft 22 rotates. Shaft 22 also fixedly supports a pinion gear 20 which meshes with a pair of further pinion gears 23 and 24 which are rotatably supported by shafts mounted on frame 1. Pinions 23 and 24 each engage with pinion 20 and with gear wheel 19.

Therefore, rotation of flywheel 21 will rotate shaft 22 and pinion 20, thereby rotating pinions 23 and 24. This will cause rotation of gear wheel 19, thereby causing the eccentrically positioned rod 18 to rotate about the central axis of gear wheel 19. This will allow block 17 to slide within slot 16 in lever 11, and thereby cause the lever to reciprocably pivot about shaft 10 between the positions shown in FIGS. 1 and 2 of the drawings. This in turn will cause head 13 to reciprocally pivot about shaft 10 between the positions shown in FIGS. 1 and 2 of the drawings. However, due to the complementary cylindrical surfaces 6, 14 and 8, 15, this pivoting movement of head 23 will result in reciprocal upward and downward sliding movement of ram 2 within the ram-supporting portion of frame 1, between the upper position shown in FIG. 1 and the lower position shown in FIG. 2 of the drawings.

It accordingly becomes possible to achieve conventional pressing operations, for example metal cutting, punching etc., with the improved machine press of the present invention. By the above construction of the present invention, it is possible to achieve a high pressing pressure between a pressing tool or mold provided on the ram 2 and a receiving mold or workpiece provided on the workpiece-supporting portion of the frame which is positioned beneath the ram.

Due to the provision of threaded adjusting shafts 4, it is possible to adjust the relative spacing between upper and lower support members 7 and 9, and to thereby adjust the degree of pressure exerted on surfaces 14 and 15 of head 13 by the complementary surfaces 6 and 8, respectively. It should be understood that the present invention is not limited to the specifically illustrated embodiment employing two threaded adjusting shafts 4, but other types of adjusting structures may be employed.

Due to the above described structure, the machine press according to the present invention has a relatively small size with respect to the relatively large size pressing power generated thereby. Due to the structure of the machine press of the present invention, the press is capable of withstanding a high backpressure on the ram 2 when the full pressing load is instantly changed to zero load during reciprocation of the ram.

Although a specific embodiment of the present invention has been described and illustrated in detail, it is specifically to be understood that the scope of the present invention is not intended to be limited to such specific structural arrangements, inasmuch as various modifications may be made thereto without departing from the scope of the present invention.

What I claim is:

1. A machine press comprising:

a frame including an upper ram supporting portion and a lower workpiece supporting portion;

a ram mounted within said ram supporting portion of said ram for upward and downward movement therein away from and towards said workpiece supporting portion of said frame, said ram having therein a recess;

upper and lower support members extending into said recess, said upper and lower support members having downwardly facing and upwardly facing surfaces which are concave, cylindrical surfaces;

a lever pivotally mounted within said frame, said lever including an upper arm having at a free end thereof a head extending into said recess, said head having upper and lower surfaces respectively contacting said downwardly facing and upwardly facing surfaces of said upper and lower support members and said upper and lower surfaces of said head being convex, cylindrical surfaces, said head being positioned between said upper and lower support members;

means for reciprocably pivoting said lever about a horizontal axis, said means being a wheel rotatably mounted on said frame, a shaft eccentrically mounted on said wheel, said lever further having a lower arm with a slot therein, a slidable member slidably positioned in said slot, said shaft extending into said slidable member, and means for rotating said wheel, whereby eccentric rotation of said shaft will cause said lever to reciprocatingly pivot about said horizontal axis; and means for adjusting a relative spacing between said upper and lower support members, and for thereby adjusting the degree of pressure exerted by said surfaces of said support members on said surfaces of said head, said means for adjusting including at least one screw threadably engaging and extending through said ram and having an inner end carrying one of said support members.

2. A machine press as claimed in claim 1, wherein said one of said support members which is carried by said at least one screw is said upper support member.

3. A machine press as claimed in claim 1, wherein said wheel comprises a gear wheel, and said rotating means comprises a rotating fly wheel and a gear train for transmitting rotation of said fly wheel to said gear wheel.

* * * * *